US009643822B2

(12) United States Patent
Eidler et al.

(10) Patent No.: US 9,643,822 B2
(45) Date of Patent: May 9, 2017

(54) PALLET OF A MOVING WALKWAY OR STEP FOR AN ESCALATOR

(71) Applicant: Inventio AG, Hergiswil (CH)

(72) Inventors: Werner Eidler, Gollersdorf (AT); Uwe Hauer, Nienburg (DE); Michael Matheisl, Vösendorf (AT); Thomas Illedits, Neufeld (AT); Robert Schulz, Vienna (AT); Christoph Makovec, Wiener Neustadt (AT); Norbert Frim, Vienna (AT)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 14/915,678

(22) PCT Filed: Aug. 28, 2014

(86) PCT No.: PCT/EP2014/068207
§ 371 (c)(1),
(2) Date: Mar. 1, 2016

(87) PCT Pub. No.: WO2015/032674
PCT Pub. Date: Mar. 12, 2015

(65) Prior Publication Data

US 2016/0221798 A1 Aug. 4, 2016

(30) Foreign Application Priority Data

Sep. 9, 2013 (EP) ..... 13183514

(51) Int. Cl.
*B66B 23/12* (2006.01)
*B66B 23/10* (2006.01)
(Continued)

(52) U.S. Cl.
CPC ..... *B66B 23/12* (2013.01); *B66B 21/02* (2013.01); *B66B 21/10* (2013.01); *B66B 23/10* (2013.01)

(58) Field of Classification Search
CPC ..... B66B 23/12; B66B 23/10; B66B 21/10; B66B 21/02
See application file for complete search history.

(56) References Cited

U.S. PATENT DOCUMENTS 5,150,780 A * 9/1992 Fischer ..... B66B 23/12 198/333
5,337,879 A 8/1994 Fischer
(Continued)

FOREIGN PATENT DOCUMENTS

JP 2013 154985 A 8/2013
WO WO 00/66476 A1 11/2000

*Primary Examiner* — Thomas Randazzo
(74) *Attorney, Agent, or Firm* — Ladas & Parry LLP

(57) ABSTRACT

The invention relates to a step (4) of an escalator or a plate (14) of a moving walkway. This comprises a tread element (40) and a support body (30) with a base (31), wherein the tread element (40) comprises at least two sub-elements (41, 42, 43) and each sub-element (41, 42, 43) is bounded in the areal extent thereof by two parallel end sides (45, 46) extending in the intended direction (X) of movement of the step (4, 304) or plate (14, 114) and two edge sides (47, 48, 147, 148) arranged orthogonally to the end sides (45, 46). The at least two sub-elements (41, 42, 43) are arranged in a predetermined sequence on the base (31) of the support body (30). Sub-elements (41, 42, 43) arranged adjacent to one another respectively bear against one another by one of the end sides (45, 46) thereof, wherein a sub-element (41, 42) previously arranged on the base (31) is secured to the support body (30) by the respective sub-element (42, 43) subsequently arranged on the base (31).

15 Claims, 4 Drawing Sheets

(51) Int. Cl.
*B66B 21/02* (2006.01)
*B66B 21/10* (2006.01)

(56) References Cited

U.S. PATENT DOCUMENTS 6,398,003 B1 * 6/2002 Jasinetzky ..... B66B 23/12
198/333
7,407,049 B2 * 8/2008 Aulanko ..... B66B 23/12
198/333
7,484,614 B2 * 2/2009 Aulanko ..... B66B 23/10
198/321
8,240,452 B2 * 8/2012 Fischer ..... B66B 23/12
198/333

* cited by examiner

FIG. 3
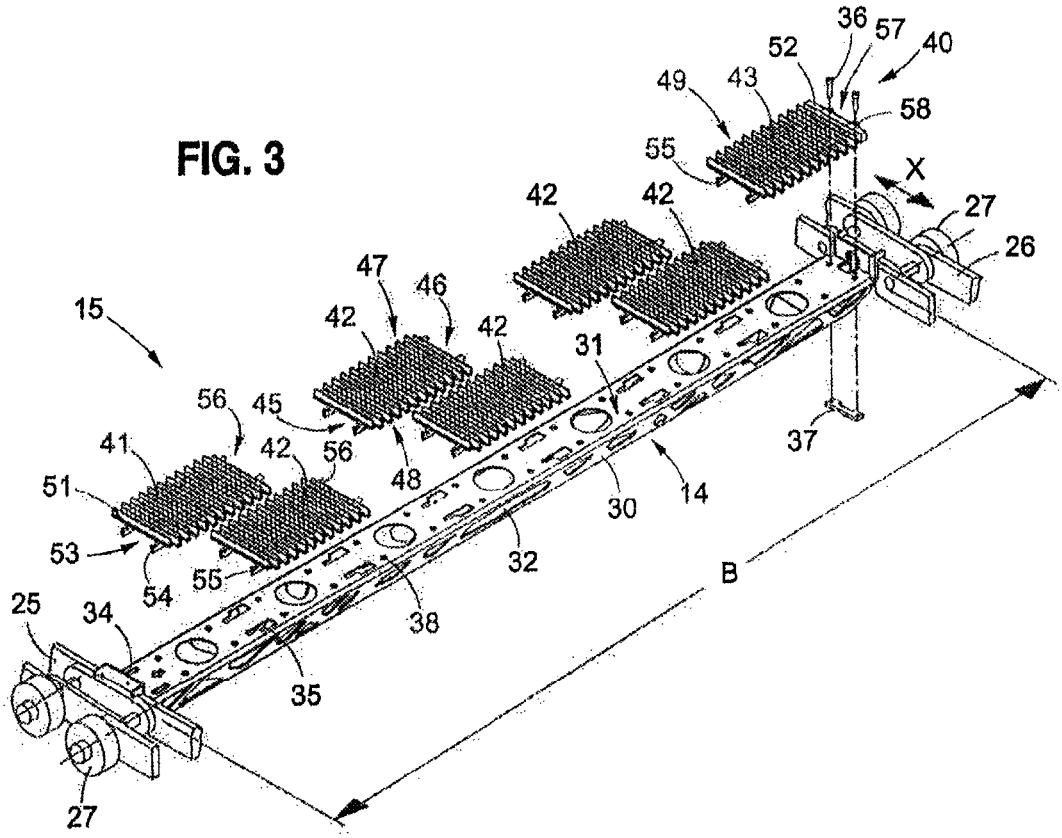
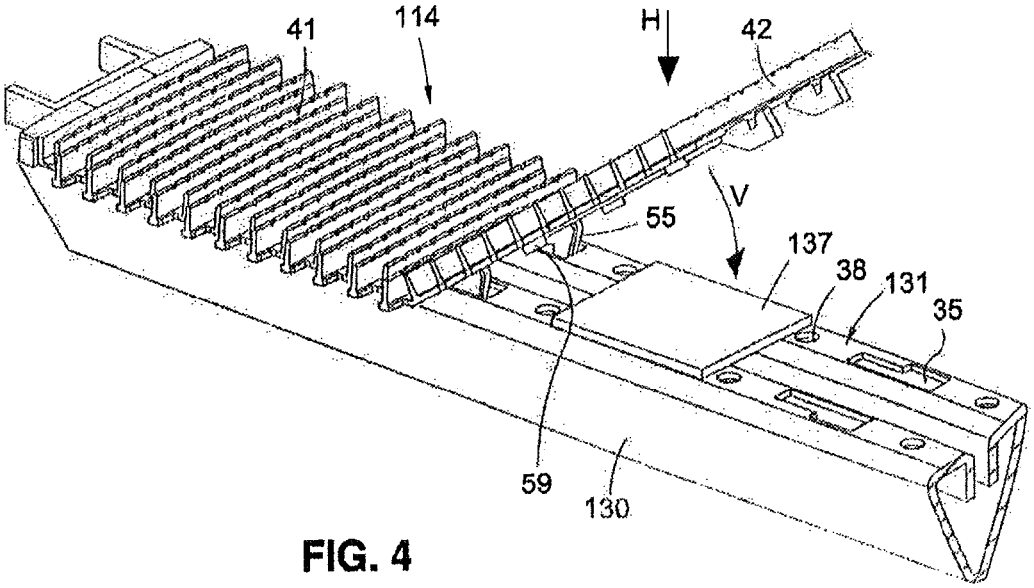
FIG. 4

PALLET OF A MOVING WALKWAY OR STEP FOR AN ESCALATOR

The invention relates to a step for an escalator or a plate for a moving walkway, which step or plate comprises a support body and a tread element.

BACKGROUND OF THE INVENTION

Conveying devices, such as escalators and moving walkways, for persons are in general known and efficient items of equipment for transportation of persons. Escalators are typically used for the transport of person in vertical direction, for example from one storey of a building to another storey, whereas moving walkways are mostly used for the transport of persons in horizontal direction or at a slight inclination up to 12 degrees from one point to another point. The length and width of the conveying device for persons are selected in dependence on the anticipated passenger traffic for the respective application.

Escalator steps and plates are conceived as single-part or multi-part components and are usually produced by a casting, extruding or forging method. The upper side of the tread elements of steps and plates has a tread pattern in the form of a row of parallel ribs or webs extending from the front side to the rear side of the tread element. The ribs thus extend in the intended direction of movement of the step or plate. In the case of escalator steps, the riser elements thereof also have ribs which usually connect with the ribs of the tread elements. Moreover, the ribs are dimensioned for engagement in comb structures at the threshold regions of the escalator or moving walkway.

Several steps are connected by way of at least one traction means to form a step belt of an escalator. In the same way, several plates are joined together to form a plate belt. A moving walkway or an escalator usually comprises a support structure with two deflecting regions, between which the plate belt or step belt is guided to circulate.

If the plates or steps are produced from cast or diecast aluminium or another suitable metal or metal alloy in one piece an extensive set of moulds has to be available, since every width of the plate belt or step belt requires an individual mould tool. However, mould tools for plates and steps are very expensive. Moreover, the size of these moulded parts, particularly the tread element with its ribs can lead to problems in casting, particularly to formation of shrink holes, so that for avoidance thereof a costly temperature control of the mould tools is necessary.

WO 0066476 A proposes, for solution of this problem, a modular construction of steps and plates so that the different widths of steps or plates can be produced by means of a few and smaller mould tools. The step or plate substantially consists of an extruded support body of aluminium and of a tread element. The tread element comprises a plurality of sub-elements. These sub-elements are fastened to the support body by means of a groove-and-key connection. A first disadvantage of this solution is that mounting of the sub-elements on the support body by lateral pushing of the keys into the grooves can be a difficult and time-consuming process, since the key-and-groove connections have a tendency to cant particularly at the start of pushing in. A second disadvantage of this solution is that the proposed groove-and-key connection has slight play, so that due to vibrations unpleasant noises can arise as a consequence of relative movements between the tread plate and the support body, since the keys are spread in the grooves only at the abutment locations between two tread elements and therefore the play between groove and key is eliminated only at these places.

BRIEF DESCRIPTION OF THE INVENTION

It is therefore the object of the present invention to create a step or plate with a support body and with a tread element which can be produced simply and economically, can be mounted quickly and simply and notwithstanding its simple construction enables silent running of the step belt or plate belt.

This object is fulfilled by a step of an escalator or a plate of a moving walkway. This comprises a tread element and a support body with a base, wherein the tread element comprises at least two sub-elements. Each sub-element is bounded in the areal extent thereof by two parallel end sides extending in the intended direction of movement of the step or plate and two edge sides arranged orthogonally to the end sides. The support body can be an extruded shaped tube or shaped section, a shaped part cut and bent from sheet metal or a step skeleton or plate skeleton composed of a plurality of parts.

The at least two sub-elements are arranged in a predetermined sequence on the base of the support body, wherein adjacently arranged sub-elements respectively bear against one another by one of the end sides thereof. A simplest possible mounting of the tread element is achieved by the fact that a sub-element previously arranged on the base is secured to the support body by the sub-element successively arranged on the base. Consequently, no additional fastening means are necessary. Moreover, by virtue of this design the tread element is connected with the support body at a plurality of locations over the width of the step or plate without additional fastening means and rests over the entire width on the support body. Further, through division into sub-elements the tread plate which is difficult to produce can be produced by means of, for example, smaller diecasting machines operating with higher cycle rates. Through the division into smaller sub-elements it is possible to produce all current step widths or plate widths with use of the same sub-elements.

The division into a support body and into a tread element has advantages not only in terms of production engineering. It is possible, through the division, to use different materials which are complementary in optimum manner. For example, a support body of steel has a substantially higher service life relative to dynamic and changing loading than a comparable support body of aluminium. An aluminium support body with compact cross-sections can hardly be used for, in particular, transport widths or plate widths or step widths higher than 1,100 millimeters, since the service life thereof would be too small due to oscillating load change.

In order to secure each sub-element, which is previously arranged on the base, to the support body by the respective sub-element successively arranged on the base at least one projection can be formed at the sub-element in the region of at least one end side. The projections of mutually adjoining end sides are so arranged that the at least one projection of the sub-element, which is previously placed on the base, hooks under or engages under the successively placed sub-element and the at least one projection of the sub-element, which is subsequently placed on the base, hooks under the base of the support body.

The feature "hook under" specifies the form of the projection, which in the mounted state projects under a suitably shaped region of a further component (sub-element or support body) in such a manner that the sub-element can no longer loosen in its principal mounting direction from the support body. The principal mounting direction is in the present case the direction by which the sub-element is placed on the support body without taking into consideration pivot movements needed in that case for introducing the projection into the further component. The principal mounting direction is usually oriented perpendicularly to the base and therefore substantially corresponds with the direction of loading of the tread element in the operationally ready state.

In order to prevent displacements of the sub-element relative to the support body even in a plane containing the base at least one positioning element can be formed at each sub-element and protrudes into a precisely fitting positioning passage of the base when the sub-element is placed. The positioning element is preferably of frusto-conical construction and the precisely fitting positioning bore a cylindrical bore so that when the sub-element is placed on the base the cone surface of the positioning element is slightly deformed by the positioning passage and adapts thereto.

The sub-elements or the projections thereof can be formed in such a manner that the previously placed element is biased against the base by the successively placed sub-element. For example, the sub-element can be formed to be curved in its width so that when the succeeding sub-element is placed the adjoining end side is pressed down onto the base. These sub-elements can obviously also be formed to be planar in the areal extent thereof and the biasing produced by means of projections. This can be achieved, for example, in that the at least one projection of the previously placed sub-element protrudes beyond the base and this part, which is termed protrusion, of the projection is pressed down onto the level of the base when the succeeding sub-element is placed.

Alternatively to the mentioned biasing or in combination with the biasing of the sub-elements the arrangement of a resilient intermediate layer between the base and the underside of the tread element would also be possible so that this resilient intermediate layer is compressed when the sub-elements are placed and the intermediate layer biases the sub-elements against the support body. The resilient intermediate layer can be, for example, a plastics material plate. However, a resilient intermediate layer can also be created by the introduction of an adhesive between the base and the underside of the tread element, whereby a particularly rigid fastening of the tread element to the support body can be achieved. Particularly suitable are pasty or liquid single-component adhesives/sealants on the basis of silane-modified polymers which cross link by humidity to form a resilient product. These are used in, for example, bodywork and vehicle construction, carriage construction and container construction as well as in metal construction and apparatus construction. All these solutions have the advantage that they can prevent formation of interface corrosion between the support body and the tread element if the material of the tread element differs from the material of the support body.

A tread element usually has different zones with respect to the design of the walkable surface thereof. The predominant part of the walkable surface has the ribs already mentioned further above, whereas, for example, the two end-side ends of the tread element can have flat surfaces without ribs.

In order to be able to reproduce such a tread element this is divided into mutually distinguishable sub-elements. One of the sub-elements can be a start element, the lefthand end side of which has a lateral edge section, which is parallel to the end side, with a fastening region. At least one righthand projection is formed in the region of the righthand end side thereof.

The directional statements "righthand" and "lefthand" used serve merely for distinction of the two end sides of a sub-element and do not have a restrictive character with respect to the direction of movement or consideration of the position of the components. These directional statements are always used in connection with projections when the projections are associated with a specific end side.

At least one fastening projection can be formed at the fastening region of the start element. When the start element is placed on the base of the support body the at least one fastening projection hooks under the base of the support body. The fastening region of the start element is thereby fastened to the support body without additional fastening means such as screws, clips, rivets or the like.

A further one of the sub-elements is, for example, a middle element, which has at least one projection at each of the two end sides. The position of the at least one lefthand projection of the lefthand end side is matched to the position of the at least one righthand projection of the previously described start element so that the two sub-elements can be arranged with the end sides thereof bearing against one another on the base of the support body. Moreover, the at least one righthand projection of the righthand end side of the middle element is arranged to be offset with respect to at least one lefthand projection of the middle element so that several middle elements can be arranged with the end sides thereof bearing against one another on the base of the support body.

A further one of the sub-elements can be an end element, the lefthand end side of which has at least one lefthand projection and the righthand end side of which has a lateral edge section, which is parallel to the end side, with a fastening region. The position of the at least one lefthand projection of the lefthand end side is in turn matched to the at least one righthand projection of the righthand end side of the start element and to the at least one righthand projection of the righthand end side of the middle element, so that the end element can be arranged on the base of the support body successively to not only a start element, but also a middle element. The fastening region has suitable attachment points for fastening means, for example passage bores for screws, threaded holes, slots, clamping surfaces for clamping claws and the like.

As explained further above, through the division of the tread element into sub-elements support bodies of different width can be fitted out by means of the same sub-elements. The narrowest plate or step has a start element which is secured to the support body by means of an end element. Insofar as the support body of a step or plate with a greater width is to be provided with a tread element, one or more middle elements can be arranged between the start element and the end element. The fitting out of a support body always begins with the start element and ends with placing of the end element, the fastening region of which is fixedly connected with the base of the support body by at least one fastening element.

A particularly stable and compact coupling of the tread element to the support body can be created if the base of the support body has at least one L-shaped mounting passage arranged in the region of mutually adjacent end sides of placed sub-elements. When the sub-elements are placed, a respective projection of the previously placed sub-element and projection of the successively placed sub-element, which projections are adjacently arranged, extend in the L-shaped mounting passage. A precisely defined securing of the previously placed sub-element by the successively placed sub-element precisely in the region of the L-shaped mounting passage is thus effected, since the previously placed sub-element at this location hooks under the successively placed sub-element and the successively placed sub-element directly adjacent thereto hooks under the base of the support body. Local unevennesses or deformations of the base and the undersides of the sub-elements thus do not have any influence on the quality of the coupling. The mounting passage can obviously also have a different hole cross-section from the L-shaped cross-sectional shape. The mounting passage can, for example, have a round, oval, square, rectangular T-shaped or U-shaped hole cross-section if such a form is expedient.

A step or plate has to have a certain degree of shape stability if it is loaded by the intended carry load or useful load. Moreover, the cross-section, which extends in the width, of the plate or step is bounded by adjoining steps or plates and spaces present in the deflecting regions. If the support body of the step or plate is of tubular construction and has a triangular or trapezium-shaped cross-section it can be deflected in the deflecting region without problem and has a high moment of resistance with respect to bending and torsional moments.

A plurality of the previously described plates is arranged at at least one traction means, whereby a plate belt for a moving walkway can be created. A step belt of an escalator is also constructed in similar manner, wherein instead of plates a plurality of steps is arranged at at least one traction means. However, usually two traction means are used for a plate belt or step belt, in which case the plates or steps are arranged between the traction means. As traction means use can be made of, for example, link chains, cables or belts. Moreover, low-friction guide elements such as rollers or slide bodies can be arranged at the support body or the traction means.

The invention obviously can be used not just in new escalators or moving walkways. For example, an existing moving walkway can be modernised by replacing the existing plate belt by a plate belt according to the invention or an escalator can be modernised by replacing the existing step belt by a step belt according to the invention.

BRIEF DESCRIPTION OF THE FIGURES

The tread element divided into sub-elements and the mounting thereof on a support body of a step or plate are explained in more detail in the following by way of examples and with reference to the drawings, in which:

FIG. 3 shows an exploded illustration of a plate belt section, wherein two traction means and a plate arranged between the traction means are illustrated;

FIG. 4 shows, in three-dimensional illustration, the placing of a sub-element on a support body of a plate;

DETAILED DESCRIPTION OF EMBODIMENTS OF THE INVENTION

Figure 1:
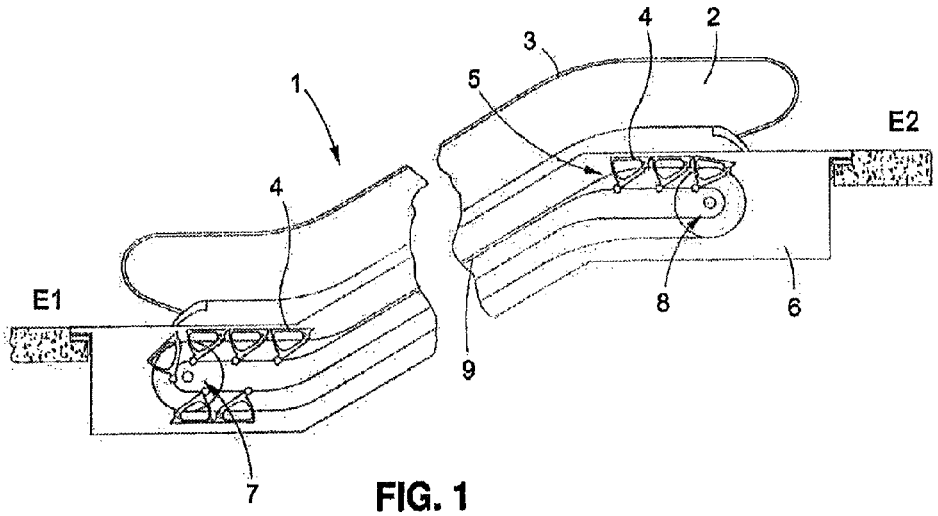
FIG. 1 shows, in schematic illustration, a moving walkway with a support structure or support frame and two deflecting regions, wherein guide rails are arranged in the support structure and an encircling step belt is arranged between the deflecting regions.

FIG. 1 schematically shows, in side view, an escalator 1, which connects a first storey E1 with a second storey E2. The escalator 1 comprises a support structure 6 or support frame 6 with two deflecting regions 7, 8, between which a step belt 5 is guided to circulate. The step belt comprises traction means 9 at which steps 4 are arranged. A handrail 3 is arranged at a balustrade 2. The balustrade 2 is connected at the lower end with the support structure 6 by means of a balustrade base.

Figure 2:
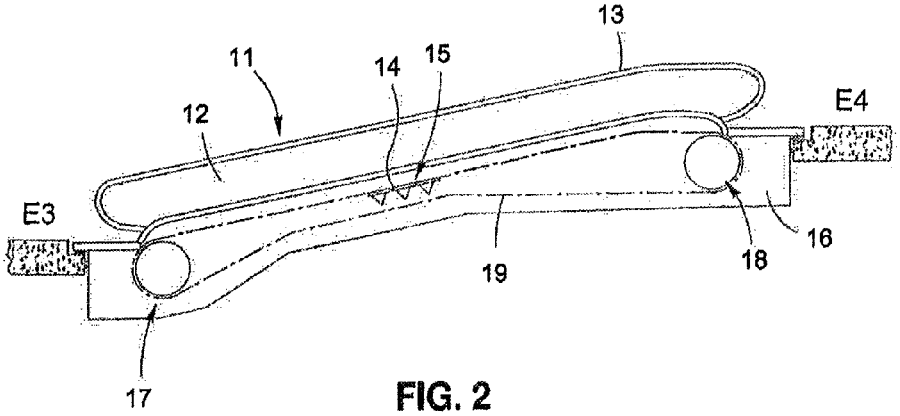
FIG. 2 shows, in schematic illustration, a moving walkway with a support structure and two deflecting regions, wherein guide rails are arranged in the support structure and an encircling plate belt is arranged between the deflecting regions.

FIG. 2 schematically shows, in side view, a moving walkway 11 in analogous construction, which similarly comprises a balustrade 12 with a balustrade base and handrail 13, a support structure 16 and two deflecting regions 17, 18. By contrast to the escalator 1 of FIG. 1, a plate belt 15 rather than a step belt is arranged between the deflecting regions 17, 18 of the moving walkway 11 to circulate. The plate belt 15 comprises traction means 19 at which plates 14 are arranged. The moving walkway 11 connects, for example, a third storey E3 with a fourth storey E4.

FIG. 3 shows an exploded illustration of a section of the plate belt 15 illustrated in FIG. 2. The plate belt 15 comprises a plurality of plates 14, which are arranged between two traction means 25, 26. For reasons of clarity only one plate 14 is illustrated. The two traction means 25, 26 are link chains, at which rollers 27 are arranged. These rollers 27 run on guide rails, which are not illustrated and which are arranged in the support structure between the deflecting regions of the escalator or the moving walkway.

The plate 14 has a support body 30, which is of tubular construction and the trapezium-shaped tubular cross-section of which (able to be better seen in FIG. 5) extends along a width B of the plate 14. The support body 30 can be made of metal, for example aluminium, brass, steel, high-alloy chromium steel, bronze or copper, but also of synthetic material, particularly of glass-fibre-reinforced and/or carbon-fibre reinforced composite materials. The support body 30 has a plurality of cut-outs 32 so as to reduce its weight. As a result of the triangular cross-section, a base 31 on which a tread element 40 can be fastened is present at the support body 30.

The tread elements 40 of steps and plates 14 have a tread pattern in the form of a row of parallel ribs 49, which extend from the front side to the rear side of the tread element 40, on the tread element top side. The ribs 49 extend in the intended direction X of movement (forwards and backwards) of the step or plate 14. According to the invention, the tread element 40 comprises a plurality of sub-elements, in a present embodiment a start element 41, several middle elements 42 and an end element 43. Each sub-element 41, 42, 43 is bounded in its areal extent by two parallel end sides 45, 46 extending in the intended direction X of movement of the step or plate 14 and two edge sides 47, 48 arranged orthogonally to the end sides 45, 46. For the sake of better clarity, the end sides 45, 46 and edge sides 47, 48 are provided with reference numerals only at one of the middle elements 42.

A tread element 40 usually has different zones with respect to the design of its walkable surface. The predominant part of the walkable surface of the tread element 40 is provided with the ribs 49, whereas, for example, the two end-side edge sections 51, 52 of the tread element 40 can have flat surfaces without ribs 49.

As already mentioned in the foregoing, the tread element 40 of the present embodiment is divided into three mutually distinguishable sub-elements 41, 42, 43. The first of the sub-elements 41 is the start element 41, the lefthand end side 45 of which has a lateral edge section 51, which is parallel to the lefthand end side 45, with a fastening region 53. In addition, two fastening projections 54 are formed at the fastening region 53. When the start element 41 is placed on the base 31 of the support body 30 the two fastening projections 54 protrude through rectangular mounting openings 34 of the base 31 and hook under the base 31 of the support body 30. The fastening region 53 of the start element 41 is thereby fastened to the support body 30 without additional fastening means such as screws, rivets, keys, clips or the like.

Two righthand projections 56, which are visible only in part, are formed in the region of the righthand end side 46 of the start element 41.

The second of the sub-elements 42 is the middle element 42, which has lefthand projections 55 at the lefthand end side 45 and righthand projections 56 at the righthand end side 46. The position of the lefthand projections 55 of the middle element 42 is matched to the position of the righthand projections 56 of the start element 41 described in the foregoing so that the middle element 42 can be arranged, with its lefthand end side 45 bearing against the righthand end side 46 of the start element 42, on the base 31 of the support body 30. In addition, the lefthand projections 55 of the middle element 42 are arranged to be offset relative to the righthand projections 56 of the middle element 42 so that, as illustrated in FIG. 3, several middle elements 42 can be arranged—with the end sides 45, 46 thereof bearing against one another—on the base 31 of the support body 30.

The third of the sub-elements 43 is the end element 43, the lefthand end side 45 of which has two lefthand projections 55 and the righthand end side 46 of which has the lateral edge section 52, which is parallel to the righthand end side 43, with a fastening region 57. The position of the two lefthand projections 55 is again matched to the two righthand projections 56 of the righthand end side 46 of the start element 41 and the righthand end side 46 of the middle element 42 so that the end element 43 can be arranged on the base 31 of the support body 30 to follow not only a start element 41, but also a middle element 42. In order that the sub-elements 41, 42, 43 can be placed and fastened in general by the projections 55, 56 thereof on the support body 30, L-shaped mounting openings 35 into which the projections 55, 56 protrude or in which they project through are formed in the base 31.

The fastening region 57 of the end element 43 has suitable attachment points 58 for fastening means 36, for example passage bores 58 for screws 36. The attachment points can obviously also be threaded holes, slots, clamping surfaces for clamping claws or the like. In the present embodiment, for mounting of the end element 43 a threaded plate 38 is arranged at the underside of the base 31. In the mounted state the screws 36 project through the attachment points 58 and the base 31 of the support body 30 until in the threaded holes of the threaded plate 37. Obviously, proprietary nuts can also be used instead of the threaded plate 37. Depending on the respective design of the base 31, the thread can also be cut directly into the base body 30.

FIG. 3 shows a quite wide plate 14, on the base 31 of the support body 30 of which five middle elements 42 are arranged between the start element 41 and the end element 43. In order to obtain a plate 14 with the smallest width B, apart from a suitably narrow support body 30 only one start element 41 is placed on the base 31 of the support body 30 and this is secured to the support body 30 by means of an end element 43. Insofar as the support body 30 of a step or plate 14 with a greater width B is to be provided with a tread element 40 one or more middle elements 42 can be arranged between the start element 41 and the end element 43. The furnishing of a support body 30 with sub-elements 41, 42, 43 thus always begins with the start element 41 and ends with the end element 43, the fastening region 57 of which is fixedly connected with the base 31 of the support body 30 by at least one fastening element 36.

In addition, positioning passages 38 with a circularly round hole cross-section are formed in the base 31. The co-operation of the positioning passages 38 and the mounting passages 35 with the sub-elements 41, 42, 43 is described in the following on the basis of FIGS. 4 to 6.

FIG. 4 shows, in three-dimensional illustration, the placing of a middle element 42 on a support body 130 of a plate 114. Even if the support body 130 differs in its form from the support body 30 illustrated in FIG. 3, the base 131 thereof also has the same mounting passages 35 and positioning passages 38. The start element 41 is already arranged on the base 131. The middle element 42 is placed in an obliquely held position in a principal mounting direction H on the base 131 of the support body 130 until the two lefthand projections 55 protrude through the mounting passages 35. The middle element 42 is subsequently pivoted or folded down towards the base 131 as is indicated by the arrow V. If a sub-element 41, 42, 43 is now pivoted, positioning elements 59 formed at the underside of the sub-element 41, 42, 43 are introduced into the precisely fitting positioning passages 38. Relative displacements of the sub-element 41, 42, 43 at the support body 130 in a plane containing the base 131 are prevented by the positioning elements 59. The positioning element 59 is preferably of frusto-conical construction and the precisely fitting positioning passage 38 is a cylindrical bore so that when the sub-element 41, 42, 43 is placed on the base 131 the cone surface of the positioning element 59 is slightly deformed by the positioning passage 38 and adapts to this. All other sub-elements 41, 43 are also placed just as the described middle element 42.

A resilient intermediate layer 137, which in the present example is divided into several sections, is arranged on the base 131 between the positioning passages 38. The resilient intermediate layer 137 can be, for example, an adhesive layer or a resilient synthetic material plate or sections of a synthetic material belt.

Figure 5:
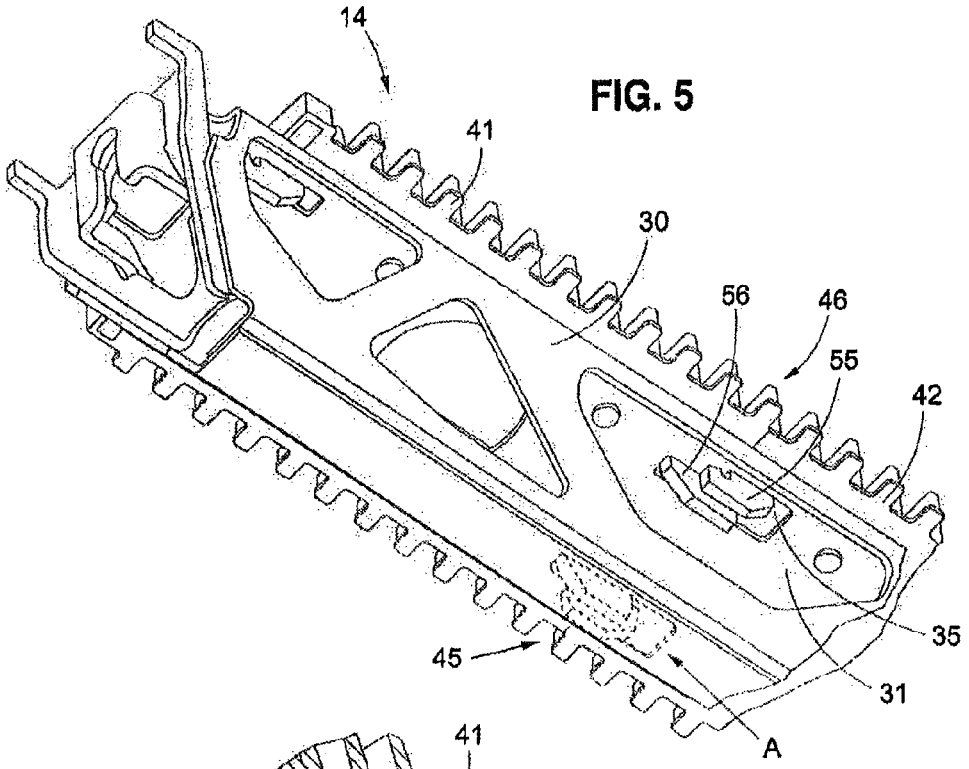
FIG. 5 shows, in three-dimensional illustration, a partial underneath view of the plate illustrated in FIG. 3.

FIG. 5 shows, in three-dimensional illustration, a partial underneath view of the plate 14, which is illustrated in FIG. 3, with already placed sub-elements. The start element 41 is thereby secured to the support body 30 by the successively placed middle element 42 in that the righthand projections 56 of the adjoining end side 46 of the start element 41 project into the mounting passages 35 and below the underside of the middle element 42 or hook under the middle element 42. The start element 41 thus can no longer be pivoted, since the successively placed middle element 42 prevents this. The lefthand projections 55, which are directed towards the start element 41, of the middle element 42 hook under the base 31 of the support body 30 and thereby prevent lifting of the middle element 42 off the base 31 at this location.

Figure 6:
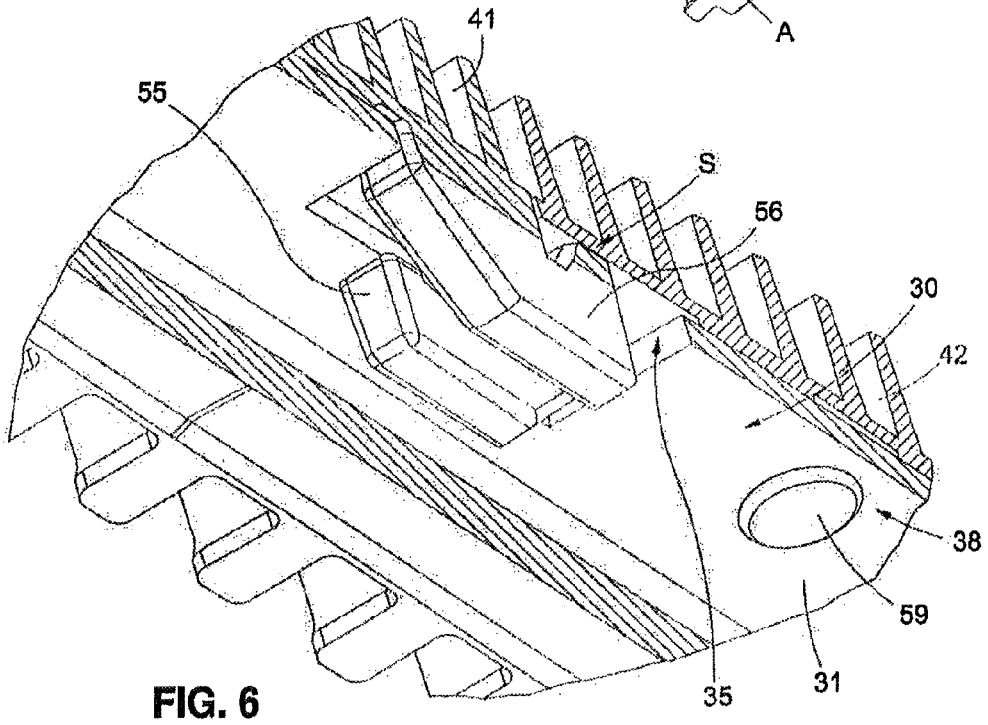
FIG. 6 shows, in three-dimensional illustration, a detail to enlarged scale of the underneath view illustrated in FIG. 5.

FIG. 6 shows, in three-dimensional illustration, a detail A of enlarged scale of the underneath view illustrated in FIG. 5. For the sake of better clarity not only the support body 30, but also the start element 41 and the middle element 42 are illustrated sectionally. This detail shows essentially a mounting passage 35 with a lefthand projection 55 of the middle element 42 and a righthand projection 56 of the start element 41, which are arranged adjacent to one another and protrude into the mounting passage 35. In particular, it is apparent that the righthand projection 56 of the start element 41 hooks not under the base 31, but under the middle element 42. In that case, in particular, the contact point S is of significance. There should be no play present between the righthand projection 56 and the underside of the middle element 42 so that the sub-elements 41, 42, 43 cannot lift off the base 31 within the scope of this play and cause clattering or rattling noises. The righthand projection 56 preferably even has a small protrusion so that in each instance the previously placed sub-element 41, 42 is biased against the base 31 by the successively placed sub-element 42, 43. Also readily recognisable is a positioning element 59, which protrudes through the positioning passage 38 of the support body 30, of the middle element 42.

Figure 7:
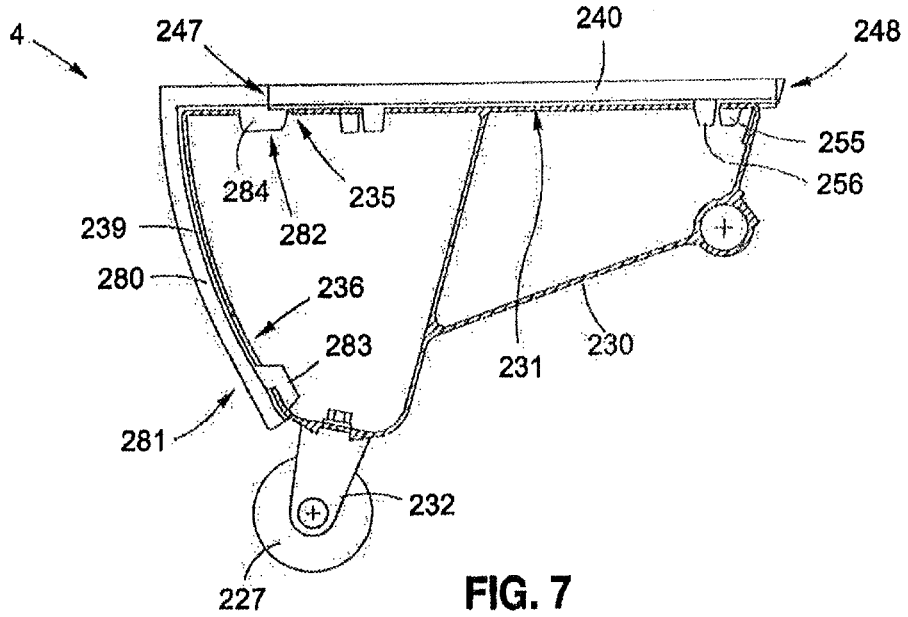
FIG. 7 shows, in sectionally illustrated side view, a step of an escalator having a tubular step body.

As illustrated in FIG. 7, the same concept can also be used for steps 4 of escalators. FIG. 7 shows, in sectionally illustrated side view, a step 4 with a tubular support body 230, which similarly has a base 231. The support body 230 is made of, for example, an aluminium extruded section. A step roller mount 232 for mounting a step roller 227 is arranged on the side of the support body 230 remote from the base 231. In the case of the step 4, as well, the tread element 240 bounded by end sides and edge sides 247, 248, which extend in the width, is divided into sub-elements. These are fastened to the support body 230 in analogous manner to the previously described plate 14, wherein in the sectional illustration merely the righthand projections 256 of the previously placed sub-element and the lefthand projections 255 of the successively placed sub-element are visible.

The step 4 further comprises a riser element 280 which has lower projections 283 and upper projections 284 arranged in the edge regions 281, 282 extending in the width. The upper projections 284 arranged in the region of the base 231 protrude into the upper mounting passages 235 without hooking under the base 231. The lower projections 283 arranged in the region of the step foot 232 protrude into lower mounting passages 236 and hook under a front wall 239 of the support body 230. Securing of the riser element 280 is therefore carried out in analogous manner to the securing of the sub-elements of the tread element 240, wherein the upper projections 284 of the riser element 280 hook under the adjoining edge region 247 of the tread element 240. The mounting concept provides that initially the riser element 280 is placed. Subsequently, the riser element 280 is secured by the tread element 240 to the support body 230 in that initially the start element, subsequently thereto and insofar as present one or more middle elements, and finally the end element are placed on the support body 230 and secured to the support body 230 by means of fastening elements.

Figure 8:
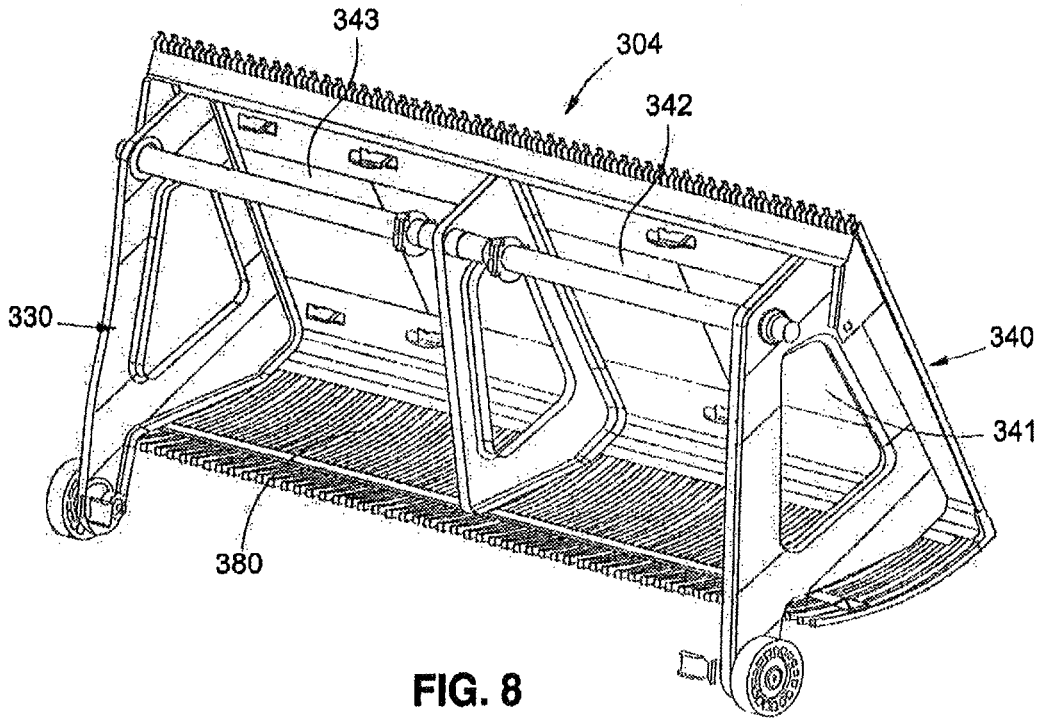
FIG. 8 shows, in three-dimensional illustration, a step of an escalator, which has a step skeleton.

The tread element divided into sub-elements can, by the fastening concept according to the invention, obviously also be used in the case of a step with a step skeleton. FIG. 8 shows in three-dimensional illustration such a step 304 of an escalator, which has a step skeleton 330. The tread element 340 is, as in the case of the aforedescribed embodiments, divided into sub-elements 341, 342, 343 and fastened to the step skeleton 330. However, the riser element 380 is a deep-drawn sheet-metal part which is, for example, welded, glued or riveted to the step skeleton 330.

Although the invention has been described by illustration of specific embodiments it will be obvious that numerous further variants of embodiment can be created with knowledge of the present invention, for example in that in the case of plates a plate skeleton is used instead of a tubular support body. Moreover, the support body can have a cross-section differing from the trapezium-shaped or triangular cross-sectional shape in that, for example, a polygonal cross-sectional shape is created by means of further folded portions. In addition, the sub-elements do not necessarily have to be a cast aluminium part. The sub-elements of the tread element can also be machined from a blank or produced by means of a forging die as a forged part. The sub-elements can obviously also consist of sheet-metal parts, particularly deep-drawn sheet-metal parts. Moreover, the sub-elements can be of a glass-fibre-reinforced and/or carbon-fibre-reinforced synthetic material or a different composite material. Furthermore, the sub-elements can also be produced at least partly from a natural stone such as granite or marble or from an amorphous material such as glass.

The invention claimed is:

1. A step/plate for an escalator or moving walkway, comprising a tread element and a support body with a base, wherein the tread element comprises at least two sub-elements, each sub-element being bounded in the areal extent thereof by two parallel end sides extending in an intended direction (X) of movement of the step/plate and two edge sides arranged orthogonally to the end sides, wherein the at least two sub-elements are arranged in a predetermined sequence on the base of the support body and wherein adjacently arranged sub-elements respectively bear against one another through contact between end sides thereof; a first sub-element on the base being secured to the support body by a second respective sub-element successively arranged on the base, wherein each sub-element has at least one projection in a region of at least one end side, the projections of adjacent end sides of two sub-elements bearing against one another are so arranged such that the at least one projection of the first sub-element previously placed on the base hooks under a subsequently placed second sub-element, and the at least one projection of the second sub-element subsequently placed on the base hooks under the base of the support body.

2. The step/plate according to claim 1, wherein the base has at least one positioning passage and each sub-element has at least one protruding positioning element formed to precisely fit into one of the at least one positioning elements when the sub-element is positioned on the base.

3. The step/plate according to claim 1, wherein a previously placed sub-element is biased by the successively placed sub-element against the base.

4. The step/plate according to claim 1, wherein a resilient intermediate layer is arranged between the support body and the tread element.

5. The step/plate according to claim 1, wherein one of the sub-elements is a start element, a first end side of which has a lateral edge section parallel to the one end side and a fastening region, a second end side of which having at least one projection.

6. The step/plate according to claim 5, wherein at least one fastening projection is formed at the fastening region for hooking under the base of the support body.

7. The step/plate according to claim 1, wherein one of the sub-elements is a middle element which has at least one left hand projection at a left hand end side and at least one right hand projection at a right hand end side.

8. The step/plate according to claim 1, wherein one of the sub-elements is an end element, a left hand end side of which has at least one left hand projection and a right hand end side of which has a lateral edge section which is parallel to the right hand end side and has a fastening region.

9. The step/plate according to claim 8, wherein when the end element is placed on the base the fastening region is fixedly connected with the base by at least one fastening element.

10. The step/plate according to claim 1, wherein the base of the support body has at least one mounting passage and, when the sub-elements are sequentially placed on the base bearing against one another, in the region of the end sides bearing against one another a projection of a previously placed sub-element and a projection of a successively placed sub-element are arranged adjacent to one another and extend in the mounting passage.

11. The step/plate according to claim 1, wherein the support body is of tubular construction and has a cross section chosen from the group consisting of triangular and trapezium shapes.

12. A plate belt of a moving walkway with at least one traction means and with a plurality of step/plates according to claim 1 arranged at the traction means.

13. A step belt of an escalator with at least one traction means and with a plurality of step/plates according to claim 1 arranged at the traction means.

14. A moving walkway with a step/plate belt according to claim 13 arranged to circulate.

15. An escalator with a step/plate belt according to claim 14 arranged to circulate.

* * * * *